US011655730B2

(12) United States Patent
Lee et al.

(10) Patent No.: US 11,655,730 B2
(45) Date of Patent: May 23, 2023

(54) STRUT STRUCTURE OF GAS TURBINE, AN EXHAUST DIFFUSER AND GAS TURBINE INCLUDING THE SAME

(71) Applicant: DOOSAN ENERBILITY CO., LTD., Changwon-si (KR)

(72) Inventors: Ik Sang Lee, Suwon-si (KR); Willy Hofmann, Uri (KR); Young Chan Yang, Changwon-si (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 16/746,962

(22) Filed: Jan. 20, 2020

(65) Prior Publication Data

US 2020/0308981 A1 Oct. 1, 2020

(30) Foreign Application Priority Data

Mar. 26, 2019 (KR) ..... 10-2019-0034660

(51) Int. Cl.
*F01D 25/16* (2006.01)
*F01D 9/04* (2006.01)
(Continued)

(52) U.S. Cl.
CPC ..... *F01D 25/162* (2013.01); *F01D 9/041* (2013.01); *F01D 25/30* (2013.01); *F01D 25/24* (2013.01);
(Continued)

(58) Field of Classification Search
CPC ..... F01D 5/141; F01D 5/143; F01D 5/145; F01D 9/02; F01D 9/04; F01D 9/041;
(Continued)

(56) References Cited

U.S. PATENT DOCUMENTS 5,609,467 A 3/1997 Lenhart
9,845,689 B2 * 12/2017 Kitagawa ..... F02C 7/00
(Continued)

FOREIGN PATENT DOCUMENTS

EP 2192270 A2 1/2009
EP 2365191 A2 9/2011
(Continued)

OTHER PUBLICATIONS

Office Action dated Oct. 20, 2020 by Japanese Patent Office.
(Continued)

*Primary Examiner* — Courtney D Heinle
*Assistant Examiner* — Danielle M. Christensen
(74) *Attorney, Agent, or Firm* — Harvest IP Law LLP

(57) ABSTRACT

A strut structure of a gas turbine, an exhaust diffuser and a gas turbine including the same are provided. The strut structure of a gas turbine, the strut structure being formed in an annular exhaust passage formed between an inner casing and an outer casing of the gas turbine, includes a strut housing configured to include a lower end which is connected to the inner casing and an upper end which is connected to the outer casing, and a strut groove configured to be formed on at least one end of the upper end and the lower end of the strut housing to connect a front end and a rear end thereof.

11 Claims, 7 Drawing Sheets

(51) Int. Cl.
*F01D 25/30* (2006.01)
*F01D 25/24* (2006.01)

(52) U.S. Cl.
CPC ..... *F05D 2240/12* (2013.01); *F05D 2240/14* (2013.01)

(58) Field of Classification Search
CPC ..... F01D 9/042; F01D 9/044; F01D 25/24; F01D 25/30; F01D 25/162; F05D 2240/12; F05D 2240/14
See application file for complete search history.

(56) References Cited

U.S. PATENT DOCUMENTS

| | | | |
|---|---|---|---|
| 2011/0214433 | A1 | 9/2011 | Palmer et al. |
| 2013/0224011 | A1 | 8/2013 | Hashimoto |
| 2016/0123164 | A1* | 5/2016 | Freeman ..... F01D 5/284 415/200 |
| 2017/0370283 | A1 | 12/2017 | Dynak |

FOREIGN PATENT DOCUMENTS

| | | | |
|---|---|---|---|
| EP | 2 602 441 | | 6/2013 |
| EP | 2657482 | A1 | 10/2013 |
| EP | 3241989 | A1 | 11/2017 |
| EP | 3260666 | A1 | 12/2017 |
| EP | 3336318 | A1 | 6/2018 |
| JP | 2014 211159 | A | 11/2014 |
| JP | 2016 089630 | A | 5/2016 |
| JP | 2018 009568 | A | 1/2018 |
| JP | 2018115656 | A | 7/2018 |
| KR | 2019980020072 | U | 7/1998 |
| KR | 1020100064752 | A | 6/2010 |
| KR | 1020100064754 | A | 6/2010 |
| KR | 1020160037557 | A1 | 4/2016 |
| KR | 1020170088036 | A | 8/2017 |
| KR | 1020200115809 | A | 10/2020 |

OTHER PUBLICATIONS

Decision for Grant by Korean Patent Office dated Nov. 19, 2020.
Office Action dated Apr. 6, 2021 by Korean Patent Office.
Notice of Allowance dated Jul. 27, 2021 by Korean Patent Office.

* cited by examiner

STRUT STRUCTURE OF GAS TURBINE, AN EXHAUST DIFFUSER AND GAS TURBINE INCLUDING THE SAME

CROSS-REFERENCE TO RELATED APPLICATION

This application claims priority to Korean Patent Application No. 10-2019-0034660, filed on Mar. 26, 2019, the disclosure of which is incorporated by reference herein in its entirety.

BACKGROUND

Field

Apparatuses and methods consistent with exemplary embodiments relate to a strut structure of a gas turbine, an exhaust diffuser and the gas turbine including the same.

Description of the Related Art

A turbine is a mechanical apparatus that obtains a rotational force by an impulse force or a reactive force by using a flow of a compressive fluid such as steam or gas, and includes a steam turbine using steam, a gas turbine using high temperature combusted gas, and the like.

The gas turbine includes a compressor, a combustor, and a turbine. The compressor includes an air inlet configured to receive air, and a plurality of compressor vanes and a plurality of compressor blades which are alternately arranged in a compressor casing.

The combustor supplies fuel to the air compressed by the compressor and ignites the fuel mixture by a burner to generate a high temperature and high pressure combusted gas.

The turbine includes a plurality of turbine vanes and a plurality of turbine blades which are alternately arranged in a turbine casing. Further, a rotor is disposed to penetrate central portions of the compressor, the combustor, the turbine, and an exhaust chamber.

The rotor is rotatably supported at both ends thereof by bearings. A plurality of disks are fixed to the rotor to connect each blade. A drive shaft of a generator is coupled to the end portion of the exhaust chamber side.

A gas turbine does not have a reciprocating mechanism such as a piston which is usually provided in four stroke engines. That is, the gas turbine has no mutual frictional portion, such as a piston-cylinder, thereby consuming extremely low lubricating oil, significantly reducing an amplitude of vibration, unlike the reciprocating machine. Therefore, high speed driving of the gas turbine is possible.

Briefly describing an operation of the gas turbine, the air compressed by the compressor is mixed with fuel, the fuel mixture is combusted to generate a high temperature combusted gas, and the generated combustion gas is discharged to the turbine side. The discharged combustion gas generates the rotational force while passing through the turbine vanes and the turbine blades, and therefore, the rotor rotates.

SUMMARY

Aspects of one or more exemplary embodiments provide a strut structure of a gas turbine, an exhaust diffuser and the gas turbine including the same, which may delay a generation of flow separation of the strut by the exhaust gas generated while the exhaust gas collides with the surface of the strut and reduce the pressure loss inside an exhaust diffuser.

Additional aspects will be set forth in part in the description which follows and, in part, will become apparent from the description, or may be learned by practice of the exemplary embodiments.

According to an aspect of an exemplary embodiment, there is provided a strut structure of a gas turbine, the strut structure being formed in an annular exhaust passage formed between an inner casing and an outer casing of the gas turbine, the strut structure including: a strut housing configured to include a lower end which is connected to the inner casing and an upper end which is connected to the outer casing; and a strut groove configured to be formed on at least one end of the upper end and the lower end of the strut housing to connect a front end and a rear end thereof.

A lower inner fillet may be formed on an upper surface of the inner casing, an upper inner fillet may be formed on a lower surface of the outer casing, and the upper inner fillet and the lower inner fillet may be partially inserted into the strut housing, and a portion not inserted into the strut housing may form the strut groove.

The lower end of the strut housing may be connected to the inner casing through the lower inner fillet, and the upper end of the strut housing may be connected to the outer casing through the upper inner fillet.

The strut groove may include a groove pattern formed on at least any one of the lower inner fillet or the upper inner fillet.

The strut groove may include a protrusion pattern formed on at least any one of the lower inner fillet or the upper inner fillet.

The strut groove may be formed by bending or cutting at least any one of the upper end and the lower end of the strut housing inward.

According to an aspect of another exemplary embodiment, there is provided an exhaust diffuser including: an inner casing configured to include a bearing housing surrounding a tie rod provided in a turbine; an outer casing configured to be spaced apart from the inner casing and include an annular exhaust passage through which an exhaust gas flows; and a strut structure formed in the annular exhaust passage formed between the inner casing and the outer casing. The strut structure may include a strut housing configured to include a lower end which is connected to the inner casing and an upper end formed to be connected to the outer casing; and a strut groove configured to be formed on at least one end of the upper end and the lower end of the strut housing to connect a front end and a rear end thereof.

A lower inner fillet may be formed on an upper surface of the inner casing, an upper inner fillet may be formed on a lower surface of the outer casing, and the upper inner fillet and the lower inner fillet may be partially inserted into the strut housing, and a portion not inserted into the strut housing forms the strut groove.

The lower end of the strut housing may be connected to the inner casing through the lower inner fillet, and the upper end of the strut housing may be connected to the outer casing through the upper inner fillet.

The strut groove may include a groove pattern formed on at least any one of the lower inner fillet or the upper inner fillet. In the exhaust diffuser of the gas turbine according to an exemplary embodiment, the strut groove may be formed by bending or cutting at least any one of the upper end and the lower end of the strut housing inward.

The strut groove may include a protrusion pattern formed on at least any one of the lower inner fillet or the upper inner fillet.

The strut groove may be formed by bending or cutting at least any one of the upper end and the lower end of the strut housing inward.

The exhaust diffuser of the gas turbine may further include an exhaust gas guide member configured to guide the exhaust gas to flow in a direction parallel to a long axis of the strut housing.

According to an aspect of another exemplary embodiment, there is provided a gas turbine including: a compressor configured to compress air externally introduced; a combustor configured to mix the compressed air with fuel and to combust the air and fuel mixture; a turbine configured to generate power with the gas supplied from the combustor, and include a turbine vane configured to guide the combustion gas on a combustion gas path through which the combustion gas passes and a turbine blade rotated by the combustion gas on the combustion gas path; and an exhaust diffuser configured to rotate the turbine blade and to exhaust the combustion gas. The exhaust diffuser may include an inner casing configured to include a bearing housing surrounding a tie rod provided in the turbine; an outer casing configured to be spaced apart from the inner casing and include an annular exhaust passage through which an exhaust gas flows; and a strut structure formed in the annular exhaust passage formed between the inner casing and the outer casing. The strut structure may include a strut housing configured to include a lower end which is connected to the inner casing and an upper end which is connected to the outer casing; and a strut groove configured to be formed on at least one end of the upper end and the lower end of the strut housing to connect a front end and a rear end thereof.

A lower inner fillet may be formed on an upper surface of the inner casing, an upper inner fillet may be formed on a lower surface of the outer casing, and the upper inner fillet and the lower inner fillet may be partially inserted into the strut housing, and a portion not inserted into the strut housing may form the strut groove.

The lower end of the strut housing may be connected to the inner casing through the lower inner fillet, and the upper end of the strut housing may be connected to the outer casing through the upper inner fillet.

The strut groove may include a groove pattern formed on at least any one of the lower inner fillet or the upper inner fillet. In the gas turbine according to an exemplary embodiment, the strut groove may be formed by bending or cutting at least any one of the upper end and the lower end of the strut housing inward.

The strut groove may include a protrusion pattern formed on at least any one of the lower inner fillet or the upper inner fillet.

The strut groove may be formed by bending or cutting at least any one of the upper end and the lower end of the strut housing inward.

The gas turbine may further include an exhaust gas guide member configured to guide the exhaust gas to flow in a direction parallel to a long axis of the strut housing.

According to one or more exemplary embodiments, it is possible to delay the generation of flow separation of the strut by the exhaust gas generated while the exhaust gas collides with the surface of the strut and to reduce the pressure loss inside the exhaust diffuser.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
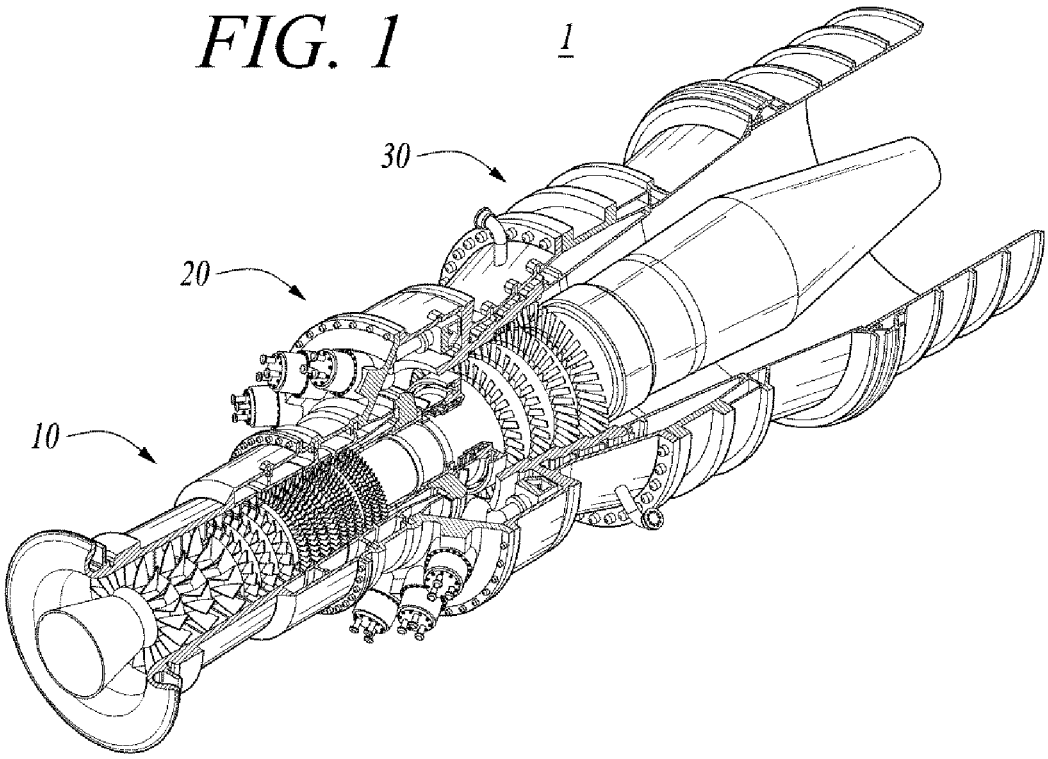
FIG. 1 is a diagram illustrating an interior of a gas turbine according to an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well, unless the context clearly indicates otherwise. In the disclosure, the terms such as "comprise", "include", "have/has" should be construed as designating that there are such features, integers, steps, operations, elements, components, and/or combinations thereof, not to exclude the presence or possibility of adding of one or more of other features, integers, steps, operations, elements, components, and/or combinations thereof. Further, throughout the specification, "on" means to be located above or below the target portion, and does not necessarily mean to be located with respect to the gravity direction.

Hereinafter, exemplary embodiments will be described in detail with reference to the accompanying drawings. It should be noted that the same components in the accompanying drawings are denoted by the same reference numerals as possible. Further, detailed descriptions of well-known functions and configurations that may obscure the gist of the disclosure will be omitted. For the same reason, in the accompanying drawings, some components have been exaggerated, omitted or schematically illustrated.

Figure 2:
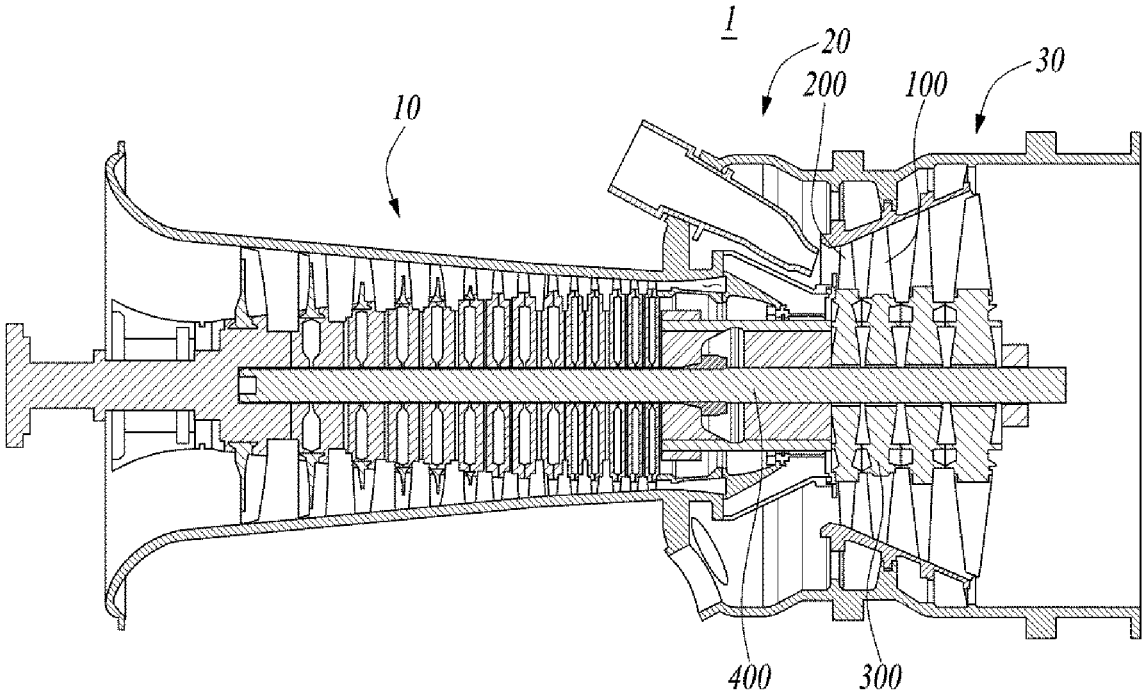
FIG. 2 is a diagram conceptually illustrating a cross section of the gas turbine according to an exemplary embodiment.

FIG. 1 is a diagram illustrating an interior of a gas turbine according to an exemplary embodiment, and FIG. 2 is a diagram conceptually illustrating a cross section of the gas turbine according to an exemplary embodiment.

Referring to FIGS. 1 and 2, a gas turbine 1 according to an exemplary embodiment includes a compressor 10, a combustor 20, and a turbine 30. The compressor 10 serves to compress the received air at high pressure, and delivers the compressed air to the combustor 20. The compressor 10 including a plurality of compressor blades radially installed rotates the compressor blade by receiving a portion of power generated by the rotation of the turbine 30, and the air is compressed and moved to the combustor 20 by the rotation of the compressor blade. A size and installation angle of the blade may be changed according to an installation position.

The air compressed by the compressor 10 is moved to the combustor 20 to be mixed with fuel through a plurality of combustion chambers and fuel nozzle modules arranged in an annular shape and combusted. The high temperature combustion gas is discharged to the turbine 30, and the turbine is rotated by the combustion gas.

The turbine 30 is arranged in multiple stages through a center tie rod 400 that axially couples a turbine rotor disk 300. The turbine rotor disk 300 includes a plurality of turbine blades 100 arranged radially. The turbine blade 100 may be coupled to the turbine rotor disk 300 in the manner such as a dovetail. Further, turbine vanes 200 fixed to a housing are provided between the turbine blades 100 to guide the flow direction of the combustion gas passing through the turbine blades 100.

As illustrated in FIG. 2, in the turbine 30, the turbine vanes 200 and the turbine blades 100 may be arranged alternately along an axial direction of the gas turbine 1. The high temperature combustion gas passes through the turbine vane 200 and the turbine blade 100 along the axial direction and rotates the turbine blade 100.

For example, after rotating the turbine blade 100, the combustion gas may be exhausted to an outside through an exhaust diffuser. Alternatively, in a combined power generation system, the combustion gas exhausted through the exhaust diffuser flows into a steam turbine through a heat exchanger to be used for another power generation. Here, the combustion gas exhausted through the exhaust diffuser is also referred to as exhaust gas.

When the exhaust gas flows from the gas turbine into the steam turbine, the hydraulic pressure and flow rate of the exhaust gas are important factors. That is, when flowing into the steam turbine, the exhaust gas should be maintained above a certain pressure, and the pressure recovery is essential for the smooth operation of the steam turbine.

In the related art strut constituting the exhaust diffuser of the gas turbine, if the exhaust gas collides with the strut, a flow separation phenomenon has occurred in which the surface of the strut is separated by the exhaust gas, and the inner pressure loss of the exhaust diffuser has been caused by this flow separation phenomenon.

Figure 3:
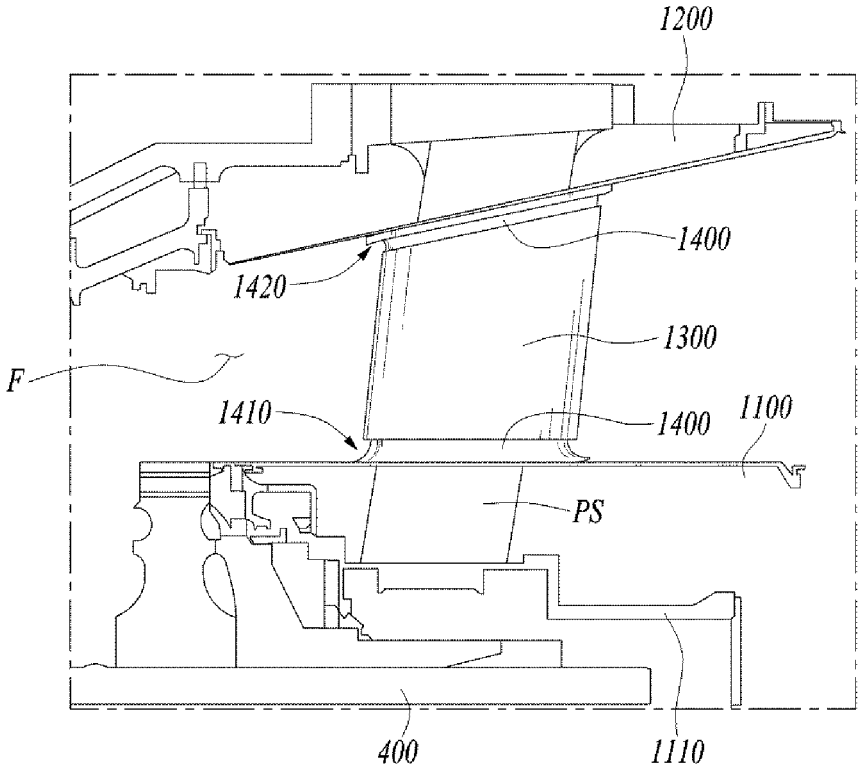
FIG. 3 is a diagram illustrating an exhaust diffuser including a strut structure of the gas turbine according to an exemplary embodiment.
Figure 4:
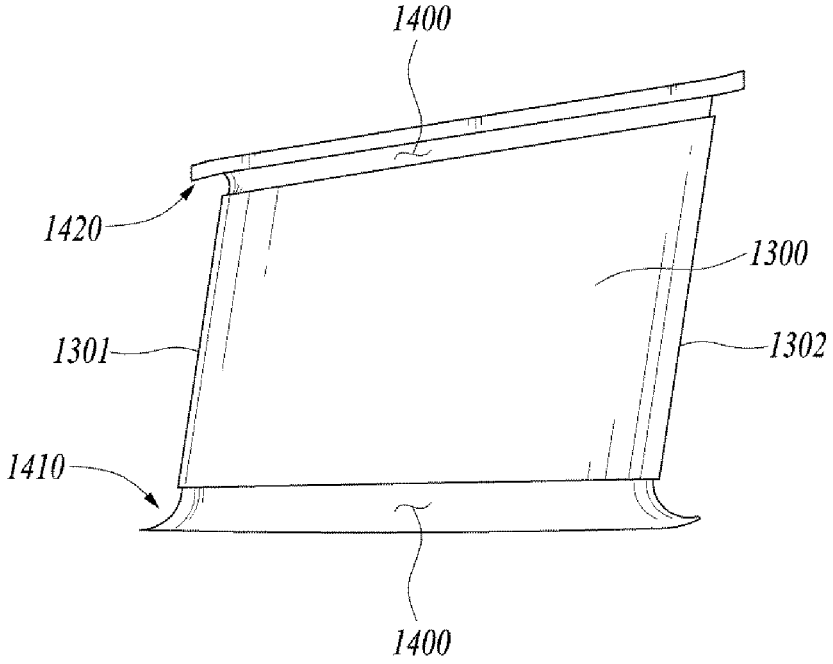
FIG. 4 is a side diagram illustrating the strut structure of the gas turbine according to an exemplary embodiment.
Figure 5:
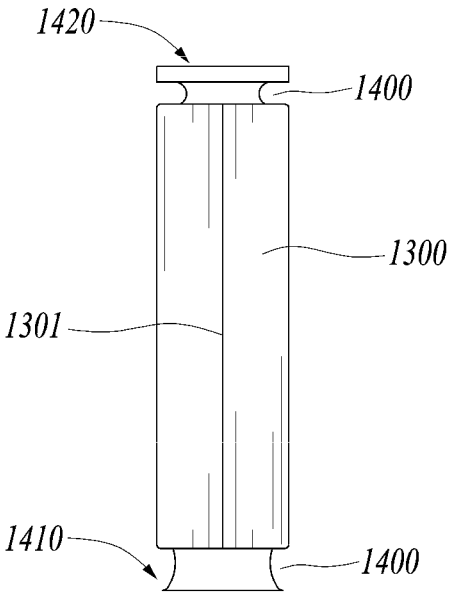
FIG. 5 is a front diagram illustrating the strut structure of the gas turbine according to an exemplary embodiment.

FIG. 3 is a diagram illustrating an exhaust diffuser including a strut structure of the gas turbine according to an exemplary embodiment, FIG. 4 is a side diagram illustrating the strut structure of the gas turbine according to an exemplary embodiment, and FIG. 5 is a front diagram illustrating the strut structure of the gas turbine according to an exemplary embodiment.

Referring to FIG. 3, the exhaust diffuser 1000 including the strut structure of the gas turbine includes an inner casing 1100, an outer casing 1200, a strut housing 1300, and a strut groove 1400.

A bearing housing 1110 surrounding the tie rod 400 provided in the turbine is formed inside the inner casing 1100. The bearing housing 1110 surrounds the tie rod 400 in a cylindrical shape and extends a predetermined length along the axial direction. The bearing housing 1110 is provided with a bearing rotating in a rolling contact state with the outside of the tie rod 400 therein, and the bearing reduces the friction of the rotating tie rod 400 and support the load, thereby seeking stable rotation and operation of the tie rod 400.

The outer casing 1200 is spaced at a predetermined distance apart from the inner casing 1100. The annular space between the inner casing 1100 and the outer casing 1200 forms an exhaust passage (F) through which the exhaust gas rotating the turbine blade 100 flows.

A plurality of power struts (PS) are arranged radially in the outside circumferential direction of the bearing housing 1110. The inner casing 1100 and the outer casing 1200 are supported by the power strut (PS) while maintaining the interval therebetween.

The power strut (PS) extends in a vertical direction from the outside of the bearing housing 1110 when viewed from a rear with respect to the axial direction of the tie rod 400. The power strut (PS) may have an ellipse shape having a long axis extending in the axial direction of the bearing housing 1110 and include an empty space therein when viewed from a top by cutting a cross section laterally.

A lower inner fillet 1410 is formed on an upper surface of the inner casing 1100, and an upper inner fillet 1420 is formed on a lower surface of the outer casing 1200. The lower inner fillet 1410 and the upper inner fillet 1420 are inserted into the strut housing 1300. At this time, a portion of the lower inner fillet 1410 and a portion of the upper inner fillet 1420 are not inserted into the strut housing 1300, and are formed to be exposed to the exhaust passage (F).

The strut housing 1300 is formed to be spaced at a predetermined distance apart from the outer circumferential surface of the power strut (PS) to surround the outer circumferential surface of the power strut (PS). A shape of the strut housing 1300 may be a shape corresponding to the shape of the outer circumferential surface of the power strut (PS). A lower end of the strut housing 1300 may be connected to the inner casing 1100 through the lower inner fillet 1410, and an upper end of the strut housing 1300 may be connected to the outer casing 1200 through the upper inner fillet 1420. The strut housing 1300 prevents the power strut (PS) from being exposed to the high temperature exhaust gas to protect the power strut (PS).

The sizes of the outer circumferential surfaces of the lower inner fillet 1410 and the upper inner fillet 1420 may be smaller than the size of the outer circumferential surface of the strut housing 1300. Therefore, the portions of the upper and lower inner fillets 1410, 1420 which are not inserted into the strut housing 1300 and the upper and lower end portions of the strut housing 1300 form a step, and the step forms the strut groove 1400. As a result, the strut groove 1400 may connect a front end 1301 and a rear end 1302 of the strut housing 1300. The strut structure includes the strut housing 1300 and the strut groove 1400.

It is understood that the strut groove 1400 is not limited to being formed by coupling of the lower and upper inner fillets 1410, 1420 and the strut housing 1300. The strut groove 1400 may be formed by bending the upper end and/or the lower end of the strut housing 1300 inward, or cutting inward them.

After rotating the turbine blade 100, the exhaust gas that is exhausted may be exhausted to another power generation system through the exhaust diffuser 1000.

If the exhaust gas flows vertically to the front end 1301 of the strut housing 1300, that is, if it flows in a direction parallel to the long axis of the elliptical strut housing 1300, the exhaust gas colliding with the front end 1301 is branched to flow along the surface of the strut housing 1300, thereby delaying the occurrence of flow separation.

However, the exhaust gas does not flow vertically to the front end 1301 of the strut housing 1300, and collides with the front end 1301 while having a predetermined angle, for example, an angle of about 20 to 30 degrees with respect to the long axis of the strut housing 1300. In this case, the exhaust gas does not flow along the surface of the strut housing 1300 and leaves the surface to lower the speed and develops a boundary layer. The development of this boundary layer results in the flow separation and the pressure loss.

The strut structure includes the strut groove 1400 connecting the front end and the rear end of the strut housing 1300, and a portion of the exhaust gas flowing at a predetermined angle to the front end 1301 of the strut housing 1300 delays the development of the boundary layer due to the turbulent effect through the vortex generation of the strut groove 1400. As described above, the development of the boundary layer may be delayed, thereby reducing the occurrence of flow separation and reducing the pressure loss.

FIGS. 6A, 6B, 6C, and 6D are diagrams illustrating the strut structures of the gas turbine according to an exemplary embodiment and a related art strut structure together.

Figure 6A:
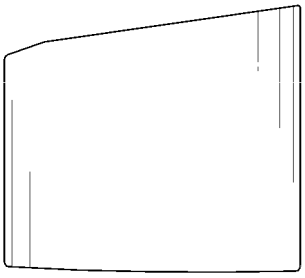
FIGS. 6A, 6B, 6C, and 6D are diagrams illustrating the strut structures of the gas turbine according to an exemplary embodiment and a related art strut structure.
Figure 6B:
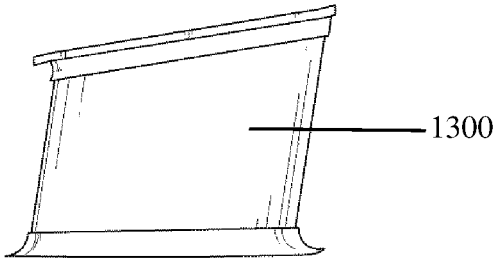
Related Art FIG. 6B

FIG. 6A is a related art strut structure in which no strut groove is formed, and FIG. 6B is a related art strut structure in which an outer fillet is formed on the upper and lower ends of the strut housing 1300 and no strut groove is formed.

Figure 6C:
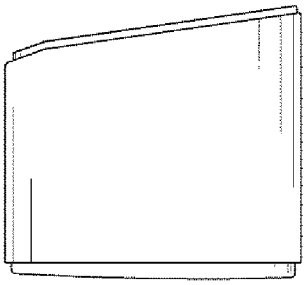
Related Art FIG. 6C
Figure 6D:
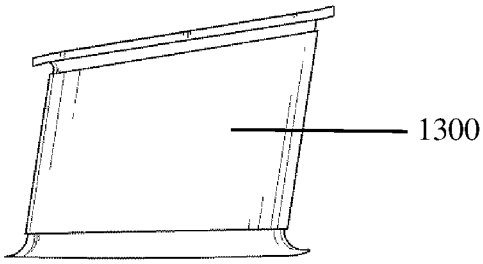

FIG. 6C is the strut structure in which the strut groove is formed, and FIG. 6D is the strut structure that inserts the inner fillet into the upper and lower ends of the strut housing 1300 to form the strut groove.

The result of modeling and simulating each strut structure of FIGS. 6A, 6B, 6C, and 6D is as in Table 1 below.

TABLE 1

| | FIG. 6A | FIG. 6B | FIG. 6C | FIG. 6D |
|---|---|---|---|---|
| Static Pressure Recovery | 0.752 | 0.753 | 0.779 | 0.784 |
| Pressure Loss [%] | 3.51 | 3.46 | 3.25 | 3.07 |

Referring to Table 1, it may be seen that the pressure loss rate of the strut structure including the strut groove (i.e., FIGS. 6C and 6D) is 3.25%, 3.07%, respectively, which is lower than 3.51%, 3.46% of the pressure loss rate of the strut structure in which no strut groove is formed (i.e., FIGS. 6A and 6B). In particular, the strut structure in which the inner fillet is inserted into the upper and lower ends of the strut housing 1300 to form the strut groove (i.e., FIG. 6D) has the lowest pressure loss rate, thereby being the most preferred embodiment.

Figure 7:
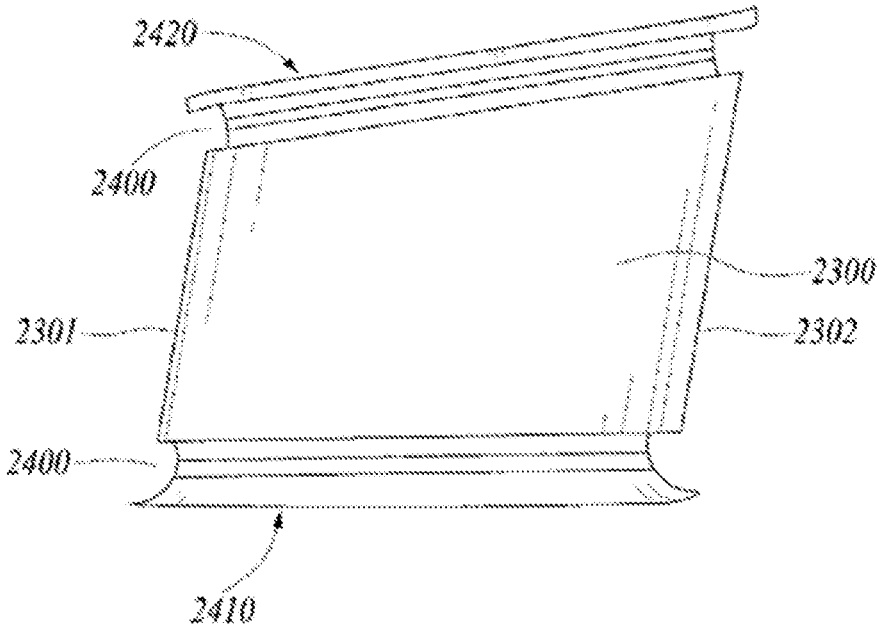
FIG. 7 is a side diagram illustrating a strut structure of a gas turbine according to another exemplary embodiment.
Figure 8:
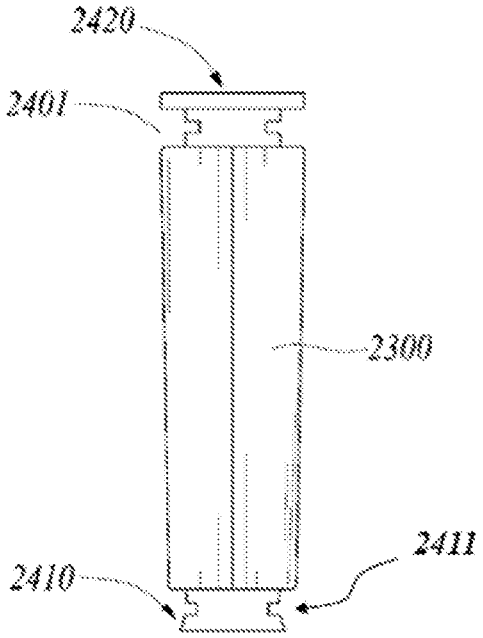
FIGS. 8 and 9 are front diagrams illustrating the strut structure of the gas turbine according to another exemplary embodiment.
Figure 9:
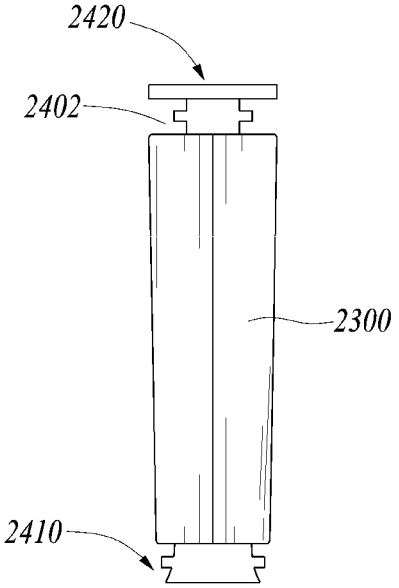

FIGS. 7 to 9 are diagrams illustrating a strut structure of a gas turbine according to another exemplary embodiment.

Referring to FIG. 7, a strut structure of a gas turbine includes a strut housing 2300 and a strut groove 2400.

Because the structure of the strut housing 2300 is substantially the same as the strut housing 1300 of FIG. 4, a detailed description thereof will be omitted.

A lower inner fillet 2410 and an upper inner fillet 2420 are inserted into an inner circumferential surface of the strut housing 2300, and a portion thereof is inserted to be exposed to the exhaust passage (F), and the exposed portion forms the strut groove 2400.

The strut groove 2400 may connect the front end 2301 and the rear end 2302 of the strut housing 2300. The strut groove 2400 further includes strut patterns 2401, 2402. For example, the strut groove 2400 includes a groove pattern 2401, which is in a form of channel 2411, as in FIG. 8 or a protrusion pattern 2402 as in FIG. 9 on the lower inner fillet 2410 and the upper inner fillet 2420. The groove pattern 2401 or the protrusion pattern 2402 may connect the front end 2301 and the rear end 2302 of the strut housing 2300.

The strut structure includes the strut groove 2400 connecting the front end and the rear end of the strut housing 2300, and the strut groove 2400 includes the groove pattern 2401 or the protrusion pattern 2402, such that a portion of the exhaust gas flowing at a predetermined angle to the front end 2301 of the strut housing 2300 may add the turbulence effect by the groove pattern 2401 or the protrusion pattern 2402 in addition to the turbulence effect through the vortex generation of the strut groove 2400, thereby further delaying the development of the boundary layer.

Figure 10:
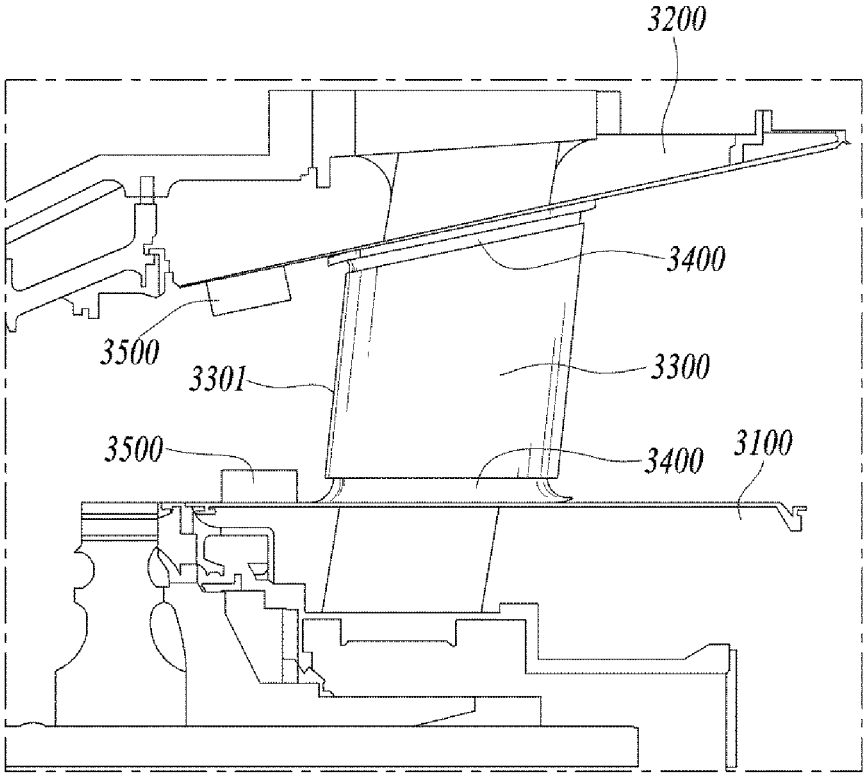
FIG. 10 is a diagram illustrating an exhaust diffuser according to another exemplary embodiment.

FIG. 10 is a diagram illustrating an exhaust diffuser according to another exemplary embodiment which includes the strut structure of the above-described exemplary embodiments.

Referring to FIG. 10, an exhaust diffuser 3000 of the gas turbine includes an inner casing 3100, an outer casing 3200, a strut housing 3300, a strut groove 3400, and an exhaust gas guide member 3500.

In the exhaust diffuser 3000 of the gas turbine, because the inner casing 3100, the outer casing 3200, the strut housing 3300, and the strut groove 3400 are substantially the same as the inner casing 1100, the outer casing 1200, the strut housing 1300, and the strut groove 1400 of FIG. 3, a detailed description thereof will be omitted.

The exhaust gas guide member 3500 is a member configured to guide a flow direction of the exhaust gas flowing into the strut housing 3300. The exhaust gas guide member 3500 guides the flow direction of the exhaust gas to flow in a direction parallel to the long axis of the elliptical strut housing 3300. Here, the "direction parallel" means to guide to flow at a smaller angle by further narrowing the flow angle of the exhaust gas that collides with the front end 3301 of the strut housing 3300 while having an angle of about 20 to 30 degrees with respect to the long axis of the strut housing 3300.

The exhaust gas guide member 3500 may be formed on at least any one of an outer circumferential surface (i.e., an upper surface) of the inner casing 3100 and an inner circumferential surface (i.e., a lower surface) of the outer casing 3200. The exhaust gas guide member 3500 may be a plate-shaped member having a predetermined height and may be arranged in plural on the outer circumferential surface of the inner casing 3100 and the inner circumferential surface of the outer casing 3200 at predetermined intervals in a circumferential direction thereof.

The exhaust diffuser 3000 may guide the flow direction of the exhaust gas to flow in a direction parallel to the long axis of the elliptical strut housing 3300 so that the exhaust gas flows through the surface of the strut housing 3300, thereby delaying the development of the boundary layer. Therefore, it is possible to delay the occurrence of flow separation and reduce the pressure loss.

Further, the exhaust diffuser 3000 includes the strut groove 3400 connecting the front end and the rear end of the strut housing 3300, such that a portion of the exhaust gas flowing at a predetermined angle to the front end 3301 of the strut housing 3300 delays the development of the boundary layer due to the turbulence effect through the vortex generation of the strut groove 3400. As described above, the development of the boundary layer may be delayed, thereby reducing the occurrence of flow separation and reducing the pressure loss.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A strut structure of a gas turbine, the strut structure being formed in an annular exhaust passage for an exhaust gas to flow, formed between an inner casing and an outer casing of the gas turbine, the strut structure comprising:

a strut housing configured to include a lower end which is connected to the inner casing and an upper end which is connected to an outer casing; and a strut groove configured to be formed on at least one end of the upper end and the lower end of the strut housing to connect a front end and a rear end thereof, wherein a lower inner fillet is formed on an upper surface of the inner casing, and an upper inner fillet is formed on a lower surface of the outer casing, wherein the lower inner fillet and the upper inner fillet are partially inserted into the strut housing, and a portion not inserted into the strut housing forms the strut groove, sizes of an outer circumferential surfaces of the lower inner fillet and the upper inner fillet are smaller than a size of an outer circumferential surface of the strut housing, portions of the upper and lower inner fillets not inserted into the strut housing and the upper and lower end portions of the strut housing form a step, and the step forms the strut groove which connects the front end and the rear end of the strut housing and reduces a pressure loss rate of the strut structure, wherein the strut groove is configured to generate a vortex of the exhaust gas, creating a turbulence effect, and wherein the strut groove further comprises a groove pattern which is a channel that extends into one of the lower and upper inner fillets, the groove pattern being configured to add further turbulence effect in addition to said turbulence effect.

2. The strut structure of claim 1, wherein the lower end of the strut housing is connected to the inner casing through the lower inner fillet, and the upper end of the strut housing is connected to the outer casing through the upper inner fillet.

3. The strut structure of claim 1, wherein the strut groove is formed by bending or cutting at least any one of the upper end and the lower end of the strut housing inward.

4. An exhaust diffuser of a gas turbine, comprising:

an inner casing configured to include a bearing housing surrounding a tie rod provided in a turbine;

an outer casing configured to be spaced apart from the inner casing and include an annular exhaust passage through which an exhaust gas flows; and a strut structure formed in the annular exhaust passage formed between the inner casing and the outer casing, wherein the strut structure comprises:

a strut housing configured to include a lower end which is connected to the inner casing and an upper end which is connected to the outer casing; and a strut groove configured to be formed on at least one end of the upper end and the lower end of the strut housing to connect a front end and a rear end thereof, wherein a lower inner fillet is formed on an upper surface of the inner casing, and an upper inner fillet is formed on a lower surface of the outer casing, wherein the lower inner fillet and the upper inner fillet are partially inserted into the strut housing, and a portion not inserted into the strut housing forms the strut groove, sizes of an outer circumferential surfaces of the lower inner fillet and the upper inner fillet are smaller than a size of an outer circumferential surface of the strut housing, portions of the upper and lower inner fillets not inserted into the strut housing and the upper and lower end portions of the strut housing form a step, and the step forms the strut groove which connects the front end and the rear end of the strut housing and reduces a pressure loss rate of the strut structure, wherein the strut groove is configured to generate a vortex of the exhaust gas, creating a turbulence effect, and wherein the strut groove further comprises a groove pattern which is a channel that extends into one of the lower and upper inner fillets, the groove pattern being configured to add further turbulence effect in addition to said turbulence effect.

5. The exhaust diffuser of the gas turbine of claim 4, wherein the lower end of the strut housing is connected to the inner casing through the lower inner fillet, and the upper end of the strut housing is connected to the outer casing through the upper inner fillet.

6. The exhaust diffuser of the gas turbine of claim 4, wherein the strut groove is formed by bending or cutting at least any one of the upper end and the lower end of the strut housing inward.

7. The exhaust diffuser of the gas turbine of claim 4, further comprising an exhaust gas guide member configured to guide the exhaust gas to flow in a direction parallel to a long axis of the strut housing.

8. A gas turbine, comprising:

a compressor configured to compress air externally introduced;

a combustor configured to mix the compressed air with fuel and to combust the air and fuel mixture;

a turbine configured to generate power with the combustion gas supplied from the combustor, and include a turbine vane configured to guide the combustion gas on a combustion gas path through which the combustion gas passes and a turbine blade rotated by the combustion gas on the combustion gas path; and an exhaust diffuser configured to rotate the turbine blade and to exhaust the combustion gas, wherein the exhaust diffuser comprises:

an inner casing configured to include a bearing housing surrounding a tie rod provided in the turbine;

an outer casing configured to be spaced apart from the inner casing and include an annular exhaust passage through which an exhaust gas flows; and a strut structure formed in the annular exhaust passage formed between the inner casing and the outer casing, and wherein the strut structure comprises:

a strut housing configured to include a lower end which is connected to the inner casing and an upper end which is connected to the outer casing; and a strut groove configured to be formed on at least one end of the upper end and the lower end of the strut housing to connect a front end and a rear end thereof, wherein a lower inner fillet is formed on an upper surface of the inner casing, and an upper inner fillet is formed on a lower surface of the outer casing, wherein the lower inner fillet and the upper inner fillet are partially inserted into the strut housing, and a portion not inserted into the strut housing forms the strut groove, sizes of an outer circumferential surfaces of the lower inner fillet and the upper inner fillet are smaller than a size of an outer circumferential surface of the strut housing, portions of the upper and lower inner fillets not inserted into the strut housing and the upper and lower end portions of the strut housing form a step, and the step forms the strut groove which connects the front end and the rear end of the strut housing and reduces a pressure loss rate of the strut structure, wherein the strut groove is configured to generate a vortex of the exhaust gas, creating a turbulence effect, and wherein the strut groove further comprises a groove pattern which is a channel that extends into one of the lower and upper inner fillets, the groove pattern being configured to add further turbulence effect in addition to said turbulence effect.

9. The gas turbine of claim 8, wherein the lower end of the strut housing is connected to the inner casing through the lower inner fillet, and the upper end of the strut housing is connected to the outer casing through the upper inner fillet.

10. The gas turbine of claim 8, wherein the strut groove is formed by bending or cutting at least any one of the upper end and the lower end of the strut housing inward.

11. The gas turbine of claim 8, further comprising an exhaust gas guide member configured to guide the exhaust gas to flow in a direction parallel to a long axis of the strut housing.

* * * * *